US007708137B1

(12) United States Patent
Rowley, Jr. et al.

(10) Patent No.: US 7,708,137 B1
(45) Date of Patent: May 4, 2010

(54) BOX FOR STORING CANDLE AND CANDLE ACCESSORIES

(75) Inventors: Joseph M. Rowley, Jr., Fairway, KS (US); Catherine A. O'Kane, Kansas City, MO (US)

(73) Assignee: Faultless Starch-Bon Ami Company, Kansas City, MO (US)

( * ) Notice: Subject to any disclaimer, the term of this patent is extended or adjusted under 35 U.S.C. 154(b) by 0 days.

(21) Appl. No.: 12/255,301

(22) Filed: Oct. 21, 2008

(51) Int. Cl.
*B65D 69/00* (2006.01)

(52) U.S. Cl. ..... 206/223; 206/514; 220/345.2; 220/345.4

(58) Field of Classification Search ..... 206/37, 206/38, 223, 68, 514, 546, 557, 577; 220/345.1–345.4, 220/351, 23.87, 23.89; 431/288, 289, 295
See application file for complete search history.

(56) References Cited

U.S. PATENT DOCUMENTS 3,349,941 A * 10/1967 Wanderer ..... 220/23.88
4,548,348 A * 10/1985 Clements ..... 206/514
4,951,832 A * 8/1990 Tenney et al. ..... 220/23.83
5,375,698 A * 12/1994 Ewart et al. ..... 220/345.4
5,441,707 A * 8/1995 Lewis et al. ..... 206/514
2004/0217116 A1* 11/2004 Offerman et al. ..... 220/345.2
2007/0227919 A1* 10/2007 True ..... 206/217

* cited by examiner

*Primary Examiner*—Luan K Bui
(74) *Attorney, Agent, or Firm*—Stinson Morrison Hecker LLP

(57) ABSTRACT

A candle box for storing individual candles and candle accessories. The box includes a housing with a top opening, a tray for storing candle accessories that fits within the top opening of the housing, and a slidable lid for covering the tray. The housing has a bottom and four side walls that define the top opening. The tray has a bottom integral with four tray side walls that, when placed within the opening of the housing, engage the interior surface of housing side walls to create an airtight enclosure. The lid has a top cover and three side walls, two of which are adapted to slidably engage any two opposing side walls of the tray. The top cover includes a snap-lock for engaging one of tray walls when the lid is in the closed position.

5 Claims, 1 Drawing Sheet

BOX FOR STORING CANDLE AND CANDLE ACCESSORIES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to storage containers, and more particularly to boxes for storing candles and associated candle accessories.

2. Description of Related Art

Candles are delicate and easily damaged. They must be transported and stored with care to prevent damage, or in case of scented candles, to assure fresh scent at the time of use. Furthermore, exposure to moisture may inhibit relighting, and continuous exposure to light may cause candle colors to fade. Finally, candle accessories, such as candle matches and candle wipes for cleaning soot from candle jars, are usually kept out of sight or stored in separate containers.

Candles are typically sold in retail boxes that usually do not meet the strict requirements for proper long term candle care, since the purpose of retail boxes is to provide an inexpensive transport container. More specifically, the retail boxes are usually made of paper material that does not effectively prevent fragrance evaporation nor protect against moisture. Thus, candle enthusiasts often have to resort to wrapping candles in paper towels, sealing them in airtight plastic pouches, and storing them out of direct sunlight.

BRIEF SUMMARY OF THE INVENTION

The present invention is directed to a box for storing candles and candle accessories. The box comprises a housing with a top opening, a tray for candle accessories adapted to fit inside the top opening of the housing, and a lid for covering the tray.

In a preferred embodiment, the box housing has a bottom and four integral side walls that define a substantially square top opening. The tray for accessories has four side walls and a tray bottom that fits within the top opening of the box housing. The housing and a tray placed in the top opening define a storage space for a candle. Furthermore, the housing walls are in contact with tray walls, creating a substantially airtight seal. The tray is covered with a removable lid that slides along two opposing tray side walls. In the closed position, the lid snap-locks onto the upper edge of one of tray walls via an indentation protruding from the bottom surface of the lid.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

A box in accordance with one embodiment of the present invention is depicted in FIGS. 1 through 4.

Figure 1:
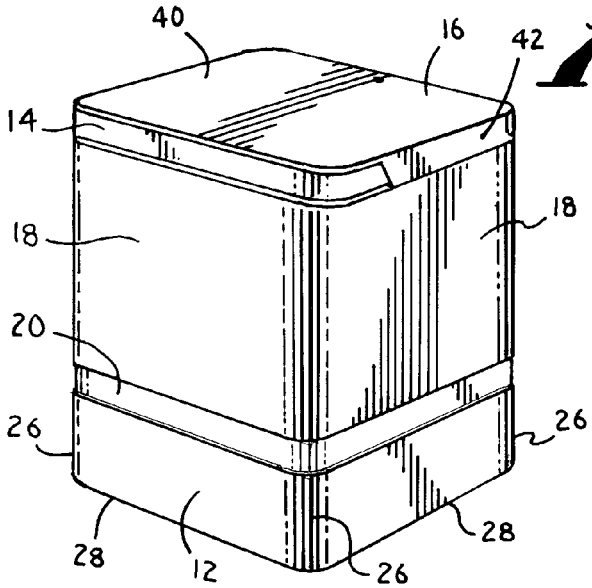
FIG. 1 is a perspective view of a box according to one embodiment of the present invention.
Figure 2:
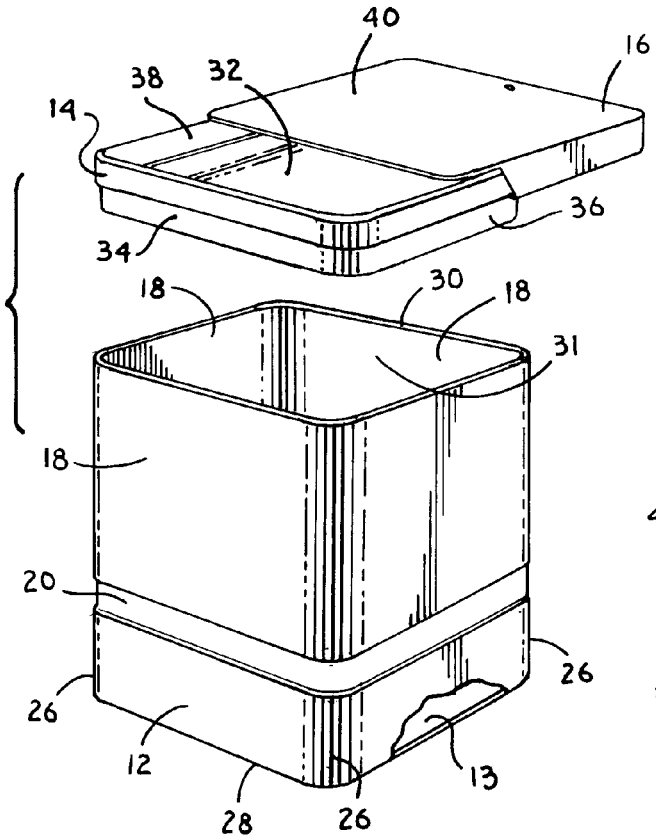
FIG. 2 is an exploded view of the box shown in FIG. 1.

Referring to FIGS. 1 and 2, box 10 in accordance with one embodiment of the present invention comprises a housing 12, a tray 14, and a lid 16. Housing 12 comprises a substantially square metal bottom 13 and metal side walls 18 connected along curved edges 26. Top edges 30 of side walls 18 define a top opening 31. In this embodiment top edges 30 are formed by folding the top of walls 18 inward and back. Side walls 18 are preferably formed from a single sheet of metal connected on itself along one of the curved connecting edges 26. Side walls 18 have a recessed portion 20 horizontally extending around the periphery of the housing 12. In this embodiment bottom edges 28 of side walls 18 are formed by folding the bottom of walls 18 inward and up, thereby engaging downwardly extending edges of bottom 13 to create a rigid connection.

Tray 14 comprises a tray bottom 32 with integral tray side walls 34. Tray side walls 34 include bottom portions 36 and top portions 38. Bottom portions 36 of tray walls 34 extend from tray bottom 32, and have external dimensions corresponding to the inside dimensions of top opening 31 of the housing 12. Top portions 38 of tray side walls 34 extend up from bottom portions 36, and are spaced outward having horizontal dimensions substantially equal to side walls 18 of the housing 12.

Figure 4:
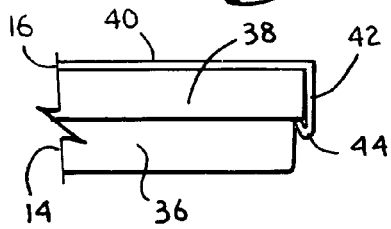
FIG. 4 is a front view of the tray and the lid of the box of FIG. 1.
Figure 3:
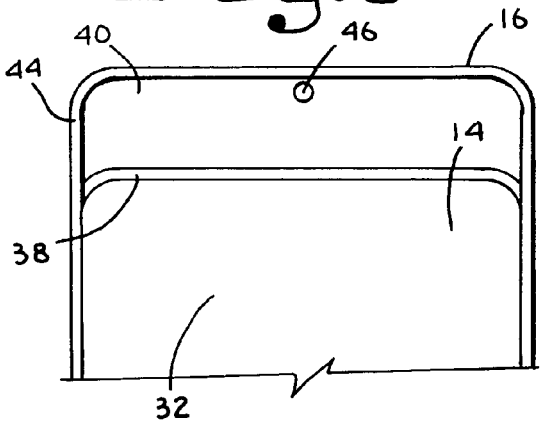
FIG. 3 is a bottom view of the tray and the lid of the box of FIG. 1 showing the lid in open position.

Lid 16 comprises a top cover 40 with three downwardly extending integral side walls 42. Top cover 40 has a substantially square shape corresponding to the top opening of tray 14. As depicted in FIG. 4, tray side walls 42 have bottom edges 44 that are curled back, i.e., inward and up. As shown in FIGS. 1, 2, and 3, top cover 40 also includes a downwardly projecting indentation 46 located proximate to the rear edge of top cover 40.

A candle is placed within housing 12 through top opening 31. Ideally, the outer perimeter of the stored candle is in close proximity to the inner surfaces of side walls 18 to prevent substantial movement of the candle within box 10, thus minimizing the possibility of damaging the stored candle. Moreover, recessed portions 20 of side walls 18 narrow the inside periphery of housing 12 further limiting the movement of the stored candle.

Tray 14 is used for storing candle accessories, such as candle matches or candle wipes. As depicted in FIG. 2, tray lid 16 is used to close tray 14 by sliding along any two opposing tray side walls 34. More specifically, as shown in FIG. 4, folded bottom edges 44 of lid walls 42 are used to grip and slidably engage top portions 38 of tray 14. In order to reveal enclosed accessories, lid 16 may be partially slid open, as shown in FIG. 2, or completely removed from tray 14. Removed lid 16 can be attached back to tray 14 from any side. Upon closing, lid 16 is locked in its closed position by engaging the attaching side wall of tray 14 with snap-lock indentation 46.

As depicted in FIG. 1, closed tray 14 is placed within top opening 31 of housing 12, thus creating a substantially sealed enclosure for the stored candle. More specifically, bottom portions 36 of tray side walls 34 engage the interior surface of housing side walls 18, thus preventing candle scent evaporation.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, is to be understood that all matters herein set forth or shown in the accompanying drawings are to be interpreted as illustrative, and not in a limiting sense.

While housing 12, tray 14, and lid 16 have been described as being made of sheet of metal, other materials or combination of materials may be used, such as plastic or wood.

While side walls 18 are preferably made from a single sheet of material, other manufacturing techniques may be used. Furthermore, while side wall edges 26 have been shown as being curved, those edges could be in other shapes.

While housing 12 has been shown as being substantially square in shape, it will be appreciated that other shapes are within the scope of the invention including rectangular, hexagonal, or any other shape with at least two substantially parallel opposing side walls.

While housing side walls 18 have been shown as having recessed portion 20, those walls could have any number of recessed portions, or could entirely lack such feature.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

What is claimed and desired to be secured by Letter Patent is as follows:

1. A box for holding a candle and candle accessories, said box comprising:

a housing for receiving said candle, said housing having a bottom coupled with side walls, and wherein said side walls define a top opening of said housing;

a tray for receiving said accessories, said tray having a tray bottom coupled with tray side walls, said tray being adapted to fit inside said top opening of said housing and supported by said side walls of said housing in spaced relationship to said housing bottom; and a removable lid adapted to cover said tray, said lid engaging with said tray, said lid comprising an indentation positioned proximate a rear edge of said lid, such that said indentation engages with one of said housing side walls when said lid is in a closed position to provide a snap-lock to retain said lid in the closed position.

2. The box of claim 1, wherein said top opening of said housing is substantially rectangular.

3. The box of claim 1, wherein at least two opposed tray side walls comprise a first and a second portion, wherein said first portion is coupled to said tray bottom, said second portion is coupled to the top edge of said first portion, and wherein said second portion is spaced outward from said first portion.

4. The box of claim 3, wherein said lid further comprises a top cover integral with three lid side walls, said lid side walls slidably gripping said second portion of said opposed tray walls.

5. A box for holding a candle and candle accessories, said box comprising:

a housing for receiving said candle, said housing having a bottom and integral side walls coupled to said bottom, said side walls defining a substantially square top opening of said housing, and said side walls having a horizontally extending recessed portion extending around the periphery of said housing;

a tray for receiving said accessories, said tray having a tray bottom integral with tray side walls, said tray being adapted to fit inside said top opening of said housing and supported by said side walls of said housing in spaced relationship to said housing bottom, wherein at least two opposed tray side walls comprise a first and a second portion of said opposed tray side walls, wherein said first portion is adjacent said tray bottom, and wherein said second portion is coupled to the top edge of said first portion and spaced outward from said first portion of said tray side walls; and a removable lid for covering said tray, said lid comprising a top cover integral with three lid side walls, said lid side walls slideably gripping said second portion of said opposed tray walls, and wherein said lid includes an indentation protruding from the bottom surface of said top cover for engaging said tray side walls when said lid covers said tray.

* * * * *